US006402804B1

(12) United States Patent
Kim et al.

(10) Patent No.: US 6,402,804 B1
(45) Date of Patent: Jun. 11, 2002

(54) PROCESS FOR PREPARING METALLIC FIBERS

(75) Inventors: Dong Yik Kim; Sung Kyun Kim, both of Junrapuk-do (KR)

(73) Assignee: Future Metal Co., Ltd., Seoul (KR)

( * ) Notice: Subject to any disclaimer, the term of this patent is extended or adjusted under 35 U.S.C. 154(b) by 0 days.

(21) Appl. No.: 09/688,163

(22) Filed: Oct. 16, 2000

(51) Int. Cl.[7] ..... B22F 3/20; B22F 5/12

(52) U.S. Cl. ..... 75/354; 419/4; 419/24; 419/67

(58) Field of Search ..... 419/4, 24, 35, 419/36, 67; 75/354

(56) References Cited

U.S. PATENT DOCUMENTS 2,719,786 A * 10/1955 Fredenburgh ..... 419/4
3,297,415 A * 1/1967 Allen ..... 419/4
6,022,509 A * 2/2000 Matthews et al. ..... 419/36
6,110,417 A * 8/2000 Sugikawa ..... 419/24
6,261,496 B1 * 7/2001 Duyckinck et al. ..... 419/36

FOREIGN PATENT DOCUMENTS

EP 0717457 * 6/1996

* cited by examiner

*Primary Examiner*—George Wyszomierski
(74) *Attorney, Agent, or Firm*—Rosenberg, Klein & Lee

(57) ABSTRACT

Disclosed is a process for preparing metallic fibers. It comprises pre-treating metal powder of a predetermined size such that finally obtained metallic fibers can be separated with ease; elongating the pre-treated metal powder at a predetermined draw ratio by use of compression molding; and separating metallic fibers from the drawn metallic material. The metallic fibers can find various applications in the electrically conducing material industries, including fillers for conducting paints, pastes and plastics, metal catalysts, electrode materials, sound-absorbing plates, and filters.

5 Claims, No Drawings

PROCESS FOR PREPARING METALLIC FIBERS

BACKGROUND OF THE INVENTION

1. Field of the Invention

The present invention relates, in general, to a process for preparing metallic fibers and, more particularly, to the mechanical deformation and plastic deformation of metal powder into metallic fibers which are suitable for use as fillers for electrically conductive paints, pastes and plastics, and for use in metal catalysts and electrodes, both requiring large contact areas, sound-absorbing plates and filters.

2. Description of the Prior Art

Electrically conductive paints or plastics, which are extensively used for electromagnetic wave shielding at present, are made of mixtures of paints or resins and conductive fillers, which are typically exemplified by metallic powder, metallic flakes, metallic fibers, and metal-coated glass fibers. In view of the fact that the electrical conductivity of conducting plastics or paints is dependent on the connection between the fillers themselves in the binders, fiber-type fillers are increasingly coming into general use by virtue of their excellent connectivity.

With applications for catalysts and electrodes, metals are required to have large specific surface area in order to increase the reaction rates in which the are involved. When existing in a fiber phase, metal can have a maximum specific surface area.

Metallic fibers also have an application for filters for special conditions, especially high temperatures, under which synthetic fibers or natural pulp fibers are difficult to use.

To be useful as conductive fillers, metallic fibers are required to have as small a diameter as possible, preferably, a diameter of 50 μm or less. When serving as a filler, a metallic fiber with a smaller diameter can be mixed at a lower fraction with a binder such as a resin or a paint. Such thin metallic fibers cannot be prepared by ordinary wire processing methods, such as wire drawing method. Thus far, various processes have been developed for preparing metal into thin fibers which are useful for such purposes.

Of them, a bundle drawing process, a vibrational cutting process and an in-rotating water melting spinning process are effective in preparing metallic fibers for conductive fillers.

By the bundle drawing process, metallic fibers with a diameter of as small as 10 μm can be prepared. Another advantage of the bundle drawing process is that the metallic fibers can be freely controlled in length through later cutting steps. However, the bundle drawing process has the drawback of incurring large expense during the bundling of wires, the repetition of wire drawing, and the separation of wires after final drawing.

Advantageous as it is in that it is conducted simply and applicable for almost all materials, the vibrational cutting process suffers from the disadvantage of being unable to reduce the diameter of metallic fibers to below 50 μm. Using only 5 wt % of the metallic fibers with a diameter of 10 μm, which can be obtained by the bundle drawing process, plastics are able to be of sufficient electrical conductivity. On the other hand, at least 35 wt % of the metallic fibers prepared by the vibrational cutting process is required to make a plastic electrically conductive.

Over the above two processes, the in-rotating water melt spinning process has the advantage that it is less costly. One problem with the in-rotating water melt spinning process, however, is the limitation of the diameter of the prepared metallic fibers to 30 μm or greater owing to the surface tension of molten metal streams jetted.

As mentioned above, it is difficult for such conventional metallic fibers-preparing techniques to avoid the problems associated with fiber diameters and production costs.

SUMMARY OF THE INVENTION

Therefore, it is an object of the present invention to overcome the above problems encountered in prior arts and to provide a process for preparing metallic fibers at low production cost and from most of the metals which are of plastic deformability, including silver, copper, aluminum and iron as well as precious metals such as palladium and platinum.

It is another object of the present invention to provide a method for preparing metallic fibers, in which metal particles are prevented from being bonded to each other during their plastic deformation, thereby easily separating individual metallic fibers from each other during the drawing process.

Based on the present invention, the above objects could be accomplished by a provision of a process for preparing metallic fibers, comprising the steps of: pre-treating metal powder of a predetermined size such that finally obtained metallic fibers can be separated with ease; elongating the pre-treated metal powder at a predetermined ratio; and separating metallic fibers from the elongated metallic material.

DETAILED DESCRIPTION OF THE INVENTION

For optimal effectiveness, conductive fillers are required to have a length of 1,000–20,000 μm and a diameter of 10–20 μm for electrically conductive plastics, catalysts, and electrodes, and a length of 10–20 μm and a diameter of around 5 μm for electrically conductive paints.

Generally, when being prepared in a spraying process, metal powder has a diameter of 30–300 μm. On the other hand, metal powder with a diameter of 1–10 μm can be obtained by a chemical process. With such properties of the preparation processes of metal powders in mind, the present inventors take advantage of utilizing metal extrusion through which metal powder can be formed into wires at an extrusion ratio of several hundreds at the maximum. This means that, metallic fibers ranging in diameter from 1 to 50 μm with a length of 10–500 μm, which are suitable for use in electrically conducting plastics, catalysts, and electrodes, can be obtained by extending a suitable size of metal powder at an appropriate rate through a elongating process such as an extruding process.

The metallic fibers that the present invention can prepare are not limited to specific kinds. In other words, almost all metal materials are usable to prepare metallic fibers in accordance with the present invention. For instance, Pt powder, Pd power, Al and Al alloy power, Ag and Ag alloy powder, Ni and Ni alloy powder, Cu and Cu alloy powder, Ti and Ti alloy powder, Co and Co alloy powder, Fe and Fe alloy powder, Ni-, Ag-, Cu-, Au-, or Pt-coated metal powder, or mixtures thereof may be used as raw materials for the metallic fibers of the present invention. Also, metallic fibers can be prepared from stainless steel powder.

In accordance with the present invention, a pre-treating step is adopted to prevent metal particles from being bonded to each other during their plastic deformation, thereby easily separating from each other the metallic fibers obtained after a elongating step. In regard to the pre-treatment, there are three routes: (1) pre-oxidation of the surface of the metal particles; (2) coating of heterogeneous metal on the surface of the metal particles; and (3) mixing of the metal powder with salt, oxide or carbon. Detailed explanations will be given of each pre-treatment case, below.

When the pretreatment takes the pre-oxidation route, the surface-oxidized metal power is molded at room temperature by compression and extruded at an extrusion ratio which is determined in consideration of the required length and diameter. The extruded metal fibers are immersed in an acidic solution which does not etch the fiber phase of the metal powder, but selectively peels the oxide coating on the metal powder, so as to leach the oxide remaining between the metal fibers. As a result, metal fibers are separately settled down.

For the coating route, the same procedure as in the pre-oxidation route is repeated, except that the etching solution is so selected as to prefer the coating layer to the metal power.

After being extruded, the metal powder which previously underwent the mixing route is treated with a solution which can selectively dissolve the salt or the oxide, so as to isolate the metal fibers. When carbon black is used to mix with the metal powder, it is oxidized to CO and $CO_2$, thereby readily separating metal fibers. Examples of available salts in the present invention include chlorides such as sodium chloride, barium chloride and potassium chloride; sulfates such as potassium sulfate and sodium sulfate; carbonates such as potassium carbonate; phosphates such as potassium phosphate; and fluorides such as sodium fluoride.

Over conventional techniques, the process of the present invention has the advantage of freely controlling the diameter and length of resulting metal fibers through the adjustment of the extrusion ratio and the selection of appropriate powder diameters and easily producing metal fibers through simple extrusion and separation; thus, surmounting the problems of conventional techniques, including shape limitation and high production cost.

The term "metal powder" as used herein means collective metal or its alloy powder and it should be understood that no limitations are imposed on the production method of the metal powder. Although being described to be carried out through extrusion herein, the elongating process of the metal powder comprises a rolling process.

A better understanding o f the present invention may be obtained in light of the following examples which are set forth to illustrate, but are not to be construed to limit the present invention.

EXAMPLE 1

Preparation of Copper Fibers Using Surface Oxidation and Extrusion of Powder 1) Copper powder prepared by use of a high-pressure spraying device was divided by size using a classifier. The copper particles with a size of 30–300 $\mu$m were oxidized at 800° C. for 30 min to form a copper oxide (CuO, $Cu_2O$) coating on the surface of the powder.

2) The copper powder whose surface was oxidized was compression-molded in a mold which had an inner diameter of 50 mm, to give rod-shaped billets which were 50 mm in outer diameter with a length of 150 mm.

3) The billets were extruded at an extrusion ratio of 200, so as to give an extruded metallic material with a diameter of 5 mm.

4) While being immersed in a 0.2 M sulfuric acid ($H_2SO_4$) solution, the extruded metal with a diameter of 5 mm was transformed into copper fibers which were 2–20 $\mu$m in diameter with a length of 6–50 mm.

EXAMPLE 2

Preparation of Silver Fibers Using Electroless Plating and Extrusion

1) Silver powder prepared by use of a high-pressure spraying device was divided by size using a classifier. The silver particles with a size of 30–300 $\mu$m were plated with nickel in an electroless plating process. The electroless plating method was carried out for 4 hours in a plating solution containing 0.1 M nickel sulfate ($NiSO_4$), 0.3 M sodium phosphite ($NaH_2PO_2$), and 0.2 M lactic acid, maintained at 90° C. The electroless plating was repeated again to increase the thickness of the coating layer. After repeating the electroless plating process twice, there was obtained a nickel coating with a thickness of about 8 $\mu$m.

2) The nickel-coated copper powder was compressively molded in a mold which had an inner diameter of 50 mm, to give rod-shaped billets which were 50 mm in outer diameter with a length of 150 mm.

3) The billets were extruded at an extrusion ratio of 200, so as to give an extruded metallic material with a diameter of 5 mm.

4) While serving as the anode, the extruded metal was electrolyzed in a 0.2 M nickel sulfate solution to deposit silver fibers which were 2–30 $\mu$m in diameter with a length of 10–30 mm.

EXAMPLE 3

Preparation of Silver Fiber Using Molten Sodium Chloride

1) NaCl (88% pure or higher) was melted in a graphite crucible which had an inner diameter of 50 mm and a height of 450 mm, and maintained at 940° C. The interior of the crucible was inclined at 5° to facilitate the release of the solidified mass therefrom. To the molten NaCl were added two weights of silver powder 100 $\mu$m in average diameter, which were prepared by use of a high pressure sprayer preheated at 500° C. After being maintained for 30 min, the melt was solidified to give a rod of silver powder-dispersed sodium chloride.

2) The rod was extruded at an extrusion ratio of 200, so as to give an extruded metallic material with a diameter of 5 mm.

3) When the extruded metallic material was placed in water to solubilize the sodium chloride, silver fibers were separated, which ranged from 2 to 20 $\mu$m in diameter with a length of 6–50 mm.

EXAMPLE 4

Preparation of Silver Fibers From Mixture of NaCl Powder and Silver Powder

1) NaCl (88% pure or higher) was ground in a ball mill to give powder with an average diameter of 30 $\mu$m.

2) With the silver powder 100 $\mu$m in average diameter, which was prepared by use of a high-pressure gas sprayer, the NaCl powder was mixed at a weight ratio of 1:2 NaCl:Ag, followed by kneading the mixture in a V-cone type kneader.

3) The powder mixture of NaCl and Ag was compressively molded in a mold which had an inner diameter of 50 mm, to give rod-shaped billets which were 50 mm in outer diameter with a length of 150 mm.

4) The billets were extruded at an extrusion ratio of 200, so as to give an extruded metallic material with a diameter of 5 mm.

5) While the metallic material was placed in water to solubilize the sodium chloride, silver fibers were separated which were 15–20 $\mu$m in diameter with a length of 10–30 mm.

EXAMPLE 5

Preparation of Silver Fiber From Mixture of Carbon Black and Silver Powder

1) With silver powder 100 $\mu$m in average diameter, which was prepared by use of a high-pressure gas sprayer, carbon black was mixed at a weight ratio of 1:4 C:Ag, followed by kneading the mixture in a V-cone type kneader using ethyl alcohol ($C_2H_5$) as a kneading enhancer at an amount of half weight of the carbon black.

2) The powder mixture of carbon black and Ag was compressively molded in a mold which had an inner diameter of 50 mm, to give rod-shaped billets which were 50 mm in outer diameter with a length of 150 mm.

3) The billets were extruded at an extrusion ratio of 200, so as to give an extruded metallic material with a diameter of 5 mm.

4) At 550° C., the metallic material was heated to oxidize the carbon to carbon monoxide or carbon dioxide which were evaporated, leaving silver fibers which were 15–20 $\mu$m in diameter with a length of 10–30 mm.

As described hereinbefore, the process of the present invention, which takes advantage of the plastic deformation of metal powder in preparing metallic fibers, is remarkably low in production cost in comparison with conventional processes of preparing metallic fibers. In addition, from most of the metals which are of plastic deformability, including precious metal such as platinum and palladium, which have not been used as fiber materials thus far, as well as silver, aluminum, copper and iron, metallic fibers can be prepared by the process of the present invention.

Another advantage with the process of the present invention is that the metallic fibers can be controlled freely in the ratio of length to diameter. Thus, substituting for metal powder in many fields including electrically conductive paints, the metallic fibers according to the present invention can bring about a significant improvement in the electrical conductivity of final products.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A process for preparing metallic fibers, comprising the steps of:

a. mixing a metal powder of a predetermined size with a water-soluble salt powder to obtain a mixture;

b. compressing the mixture in a mold to obtain a billet;

c. elongating the billet at a predetermined ratio; and d. treating the elongated billet with a solution in order to remove the salt from the elongated billet to obtain the metallic fibers.

2. The process of claim 1, wherein the elongating step is an extrusion or rolling process.

3. The process of claim 1, wherein the metal powder is selected from the group consisting of Pt powder, Pd powder, Al and Al alloy powder, Ag and Ag alloy powder, Ni and Ni alloy powder, Cu and Cu alloy powder, Ti and Ti alloy powder, Co and Co alloy powder, Fe and Fe alloy powder, Ni-, Ag-, Cu-, Au-, or Pt-coated metal powder mixtures of the above powder, and stainless steel powder.

4. The process of claim 1, wherein the mixing step is carried out adding the metal powder to molten salt at a predetermined weight ratio, maintaining them for a period of time, and solidifying the molten salt to give a solid salt in which the metal powder is dispersed.

5. The process of claim 1, wherein the salt is selected from the group consisting of sodium chloride, barium chloride, potassium chloride, potassium sulfate, sodium sulfate, potassium carbonate, phosphates, and sodium fluoride.

* * * * *